US011317748B2

(12) United States Patent
Foster

(10) Patent No.: US 11,317,748 B2
(45) Date of Patent: May 3, 2022

(54) PROGRAMMABLE LOCK BOX

(71) Applicant: Jacqueline Foster, Sacramento, CA (US)

(72) Inventor: Jacqueline Foster, Sacramento, CA (US)

( * ) Notice: Subject to any disclaimer, the term of this patent is extended or adjusted under 35 U.S.C. 154(b) by 0 days.

(21) Appl. No.: 17/067,545

(22) Filed: Oct. 9, 2020

(65) Prior Publication Data

US 2021/0228011 A1 Jul. 29, 2021

Related U.S. Application Data

(60) Provisional application No. 62/964,836, filed on Jan. 23, 2020.

(51) Int. Cl.
*A47G 29/14* (2006.01)
*G07C 9/00* (2020.01)

(52) U.S. Cl.
CPC ..... *A47G 29/141* (2013.01); *G07C 9/00182* (2013.01); *A47G 2029/143* (2013.01); *G07C 2009/0019* (2013.01); *G07C 2009/00801* (2013.01)

(58) Field of Classification Search
CPC ..... A47G 29/141; A47G 2029/143; A47G 2029/144; A47G 2029/147; A47G 29/20; A47G 29/22; G07C 9/00182; G07C 2009/0019; G07C 2009/00801; G07C 9/0069; G07C 2009/00857; G07C 9/00912; B65D 2590/664; B65D 2590/666
USPC ..... 340/5.73
See application file for complete search history.

(56) References Cited

U.S. PATENT DOCUMENTS 8,712,365 B2 * 4/2014 Metivier ..... G07C 9/00309 455/352
2003/0066170 A1 * 4/2003 Huang ..... A44B 19/301 24/387
2009/0226050 A1 * 9/2009 Hughes ..... G08B 21/0208 382/124
2010/0085148 A1 * 4/2010 Nesling ..... G07C 9/00912 340/5.73
2015/0040622 A1 * 2/2015 Meersschaert ..... E05B 37/0048 70/69
2015/0091693 A1 * 4/2015 Bibeau ..... B65D 33/2591 340/5.25
2015/0235495 A1 * 8/2015 Hall ..... G07C 9/00896 340/5.51
2015/0305538 A1 * 10/2015 Sundaresan ..... E05B 73/0005 232/36
2018/0298645 A1 * 10/2018 Klinkman ..... A45C 13/20
(Continued)

*Primary Examiner* — Edwin C Holloway, III
(74) *Attorney, Agent, or Firm* — Ivan E. Rozek; Savantek Patent Services

(57) ABSTRACT

A programmable locking assembly for an insulated enclosure such as a food delivery box that can be unlocked by the recipient of the box, by pressing a number code on the keypad of the lock, causing a locking finger to slide out from a zipper pull on the lid of the insulated enclosure to allow the recipient unzip the lid to have access to the contents of the enclosure, thereby preventing the food delivery person to access the contents of the enclosure while in route to making the delivery. The number code is texted to the recipient from the sender of the enclosure. In an alternate embodiment, an audio tone can open the lock without the user needing to press numbers on the keypad.

5 Claims, 15 Drawing Sheets

(56) References Cited

U.S. PATENT DOCUMENTS

| | | | | |
|---|---|---|---|---|
| 2019/0223644 | A1* | 7/2019 | Hopp | A47G 29/20 |
| 2020/0165861 | A1* | 5/2020 | Bruno | B65D 81/38 |

* cited by examiner

PROGRAMMABLE LOCK BOX

CROSS REFERENCE TO RELATED APPLICATIONS

Provisional Patent Application, 62/964,836, filing date 01/23/2020

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of lockable containers and more specifically to an insulated programmable lock box primarily for use for food delivery services.

Food delivery from restaurants to customers in their homes or offices has become very popular.

Basically, the restaurant puts the food in an insulated enclosure and has a food delivery person transport the enclosure to the recipient, at which time the recipient removes the food from the enclosure and takes it into their home or office.

However, there have been reported cases of food delivery people gaining access to the insulated enclosure and partaking of the food inside before making the delivery to the end customer. This situation is unacceptable both for the reason of the theft of food and for the possibility of having the food become contaminated by the delivery person's fingers.

BRIEF SUMMARY OF THE INSTANT INVENTION

The primary object of the invention is to provide a lockable box or enclosure whose lock can be programmed with a custom number sequence which an end user needs to know in order to open the box.

Another object of the invention is to provide a programmable lock box that is insulated and used for food delivery from restaurants to individuals at their homes or offices thereby preventing the delivery person from having access to the contents of the box.

Another object of the invention is to provide a programmable lock box that allows a restaurant to send a numerical text to the recipient of the boxed food to so that the recipient can enter the numerical code to open the box.

A further object of the invention is to provide a programmable lock box that allows the recipient of the boxed food to place their smart phone near the box hand have the phone send an audio signal that will unlock the box so that the recipient does not have to physically touch the keypad of the lock.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a programmable lock box comprising: an insulated enclosure, an lock assembly, a number code receiver assembly enclosed within a housing, a number code receiver holster, an electronic numerical code generating system, a phone texting electronic circuit that sends said electronic numerical code to the smart phone of the recipient of said insulated enclosure, said lock assembly including an electro-mechanical sliding locking finger that extends through an aperture in said insulated enclosure, said number code receiver holster fixedly attached to the outside wall of said insulated enclosure said locking finger also capable of penetrating an aperture in a metal flange attached to said holster and also penetrating an aperture in a zipper pull tab, said number code receiver assembly including a keypad, a numeric display, a programmable microprocessor, a rechargeable battery and a short range receiver contained within a hollow housing, said recipient of said insulated enclosure capable of sliding said locking finger away from said aperture of said zipper pull tab by pressing the proper code numbers received from said phone texting electronic circuit thereby allowing said recipient to unzip the lid of said enclosure and have access to the contents of said enclosure.

BRIEF DESCRIPTION OF THE DRAWINGS

The drawings constitute a part of this specification and include exemplary embodiments to the instant invention, which may be embodied in various forms. It is to be understood that in some instances various aspects of the instant embodiments may be shown exaggerated or enlarged to facilitate an understanding of the instant embodiment.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
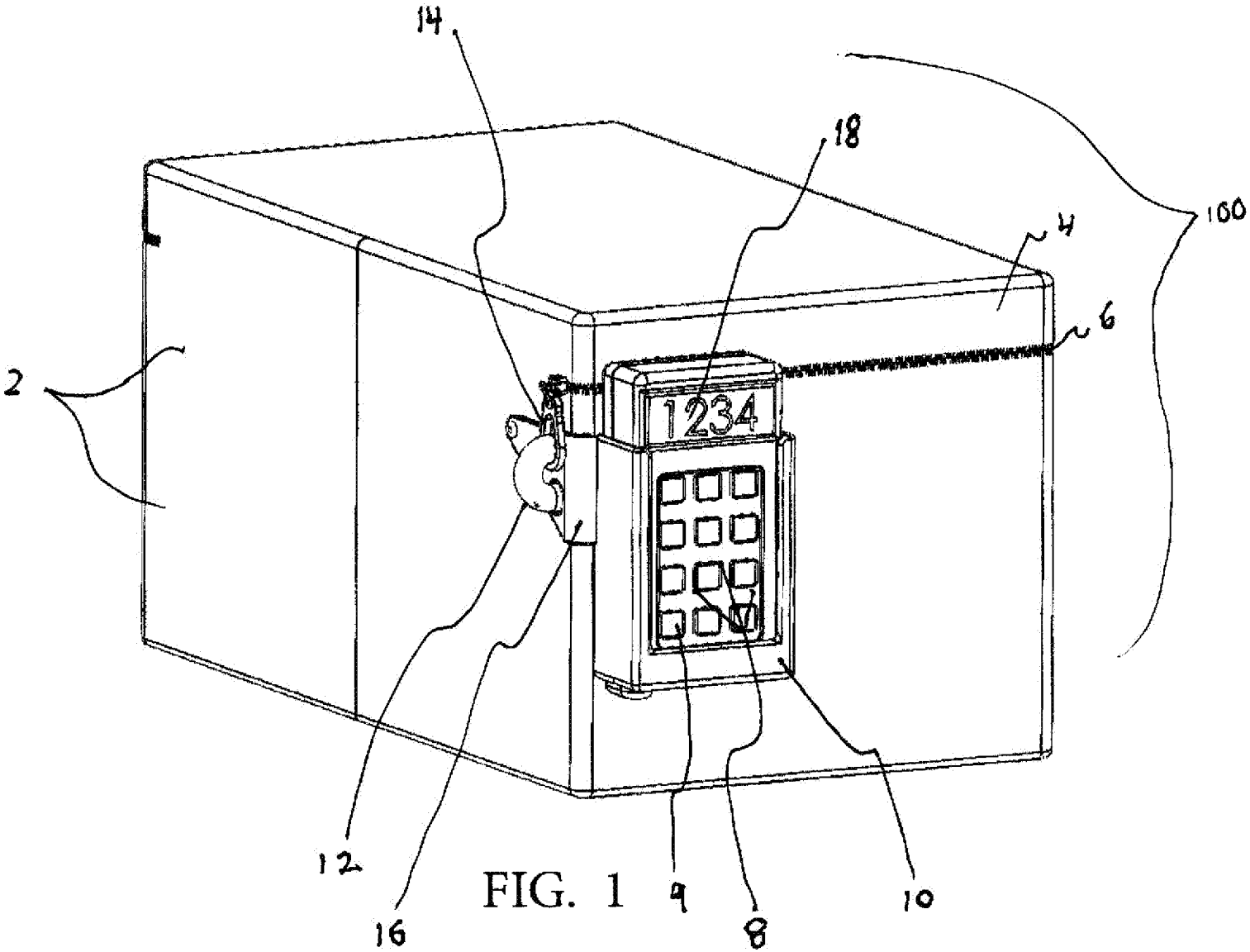
FIG. 1 is a perspective view of the invention.

Referring now to FIG. 1 we see a perspective view of the invention 100. An insulated enclosure box 2 includes a zippered 6 lid 4. The zipper pull 14 is restricted from being pulled by a U shaped locking finger 12. A number code receiving device 8 is installed in a holster 10. The rigid holster 10 includes a rigid flange 16 that reinforces the apertures that retain the U-shaped locking finger 12. Therefore, the enclosure 2 can be made of sewn material such as ballistic nylon and yet the flange area 16 of the U-shaped locking finger 12 hardens the connection point between the U-shaped locking finger 12 and the enclosure 2. In the instance of food delivery, a person at the restaurant sending the food uses a custom electronic software program to generate a unique sequence of numbers in a microprocessor located within the number code receiving device 8 housing. A delivery person then transports the enclosure 2 to a recipient at a home or office. The restaurant person texts a unique sequence of numbers to the recipient's smart phone. The recipient can then press the keypad numbers 9 in the sequence shown in the text message to cause the U-shaped locking finger to slide out, thereby gaining access to the zipper pull 14. In this way, only the recipient, and not the food delivery person, has access to the food being stored within the enclosure 2.

Figure 2:
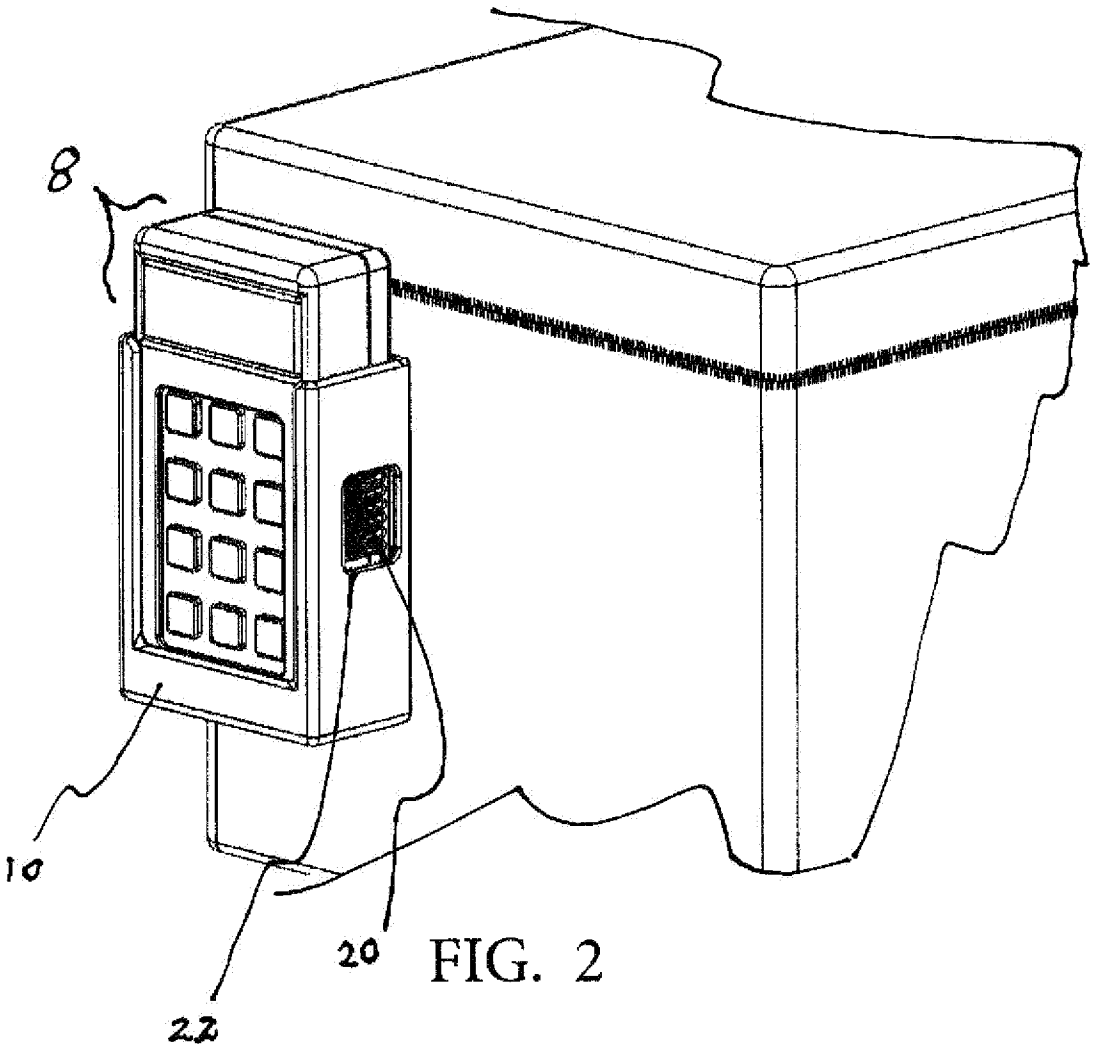
FIG. 2 is a partial perspective view of the invention.

FIG. 2 shows the right side of the holster 10 where an aperture 22 in the holster 10 allows the reception of an audible tone to enter grill 20 of code receiving unit 8. The audible tone is an optional way to cause the lock to open as will be discussed below. The code receiving device 8 includes a keypad 9 and a numerical display 18. The upper portion of the number code receiving device numerical display 18 confirms the numbers that the recipient has selected. Another way that the recipient can activate the lock is to place his or her smart phone near the enclosure and to press an audio option within the text message which then generates tones associated with each number. A microphone 42 within the number code receiving housing hears the tones and unlocks the U-shaped locking finger 12 when the correct sequence of tones is heard.

Figure 3:
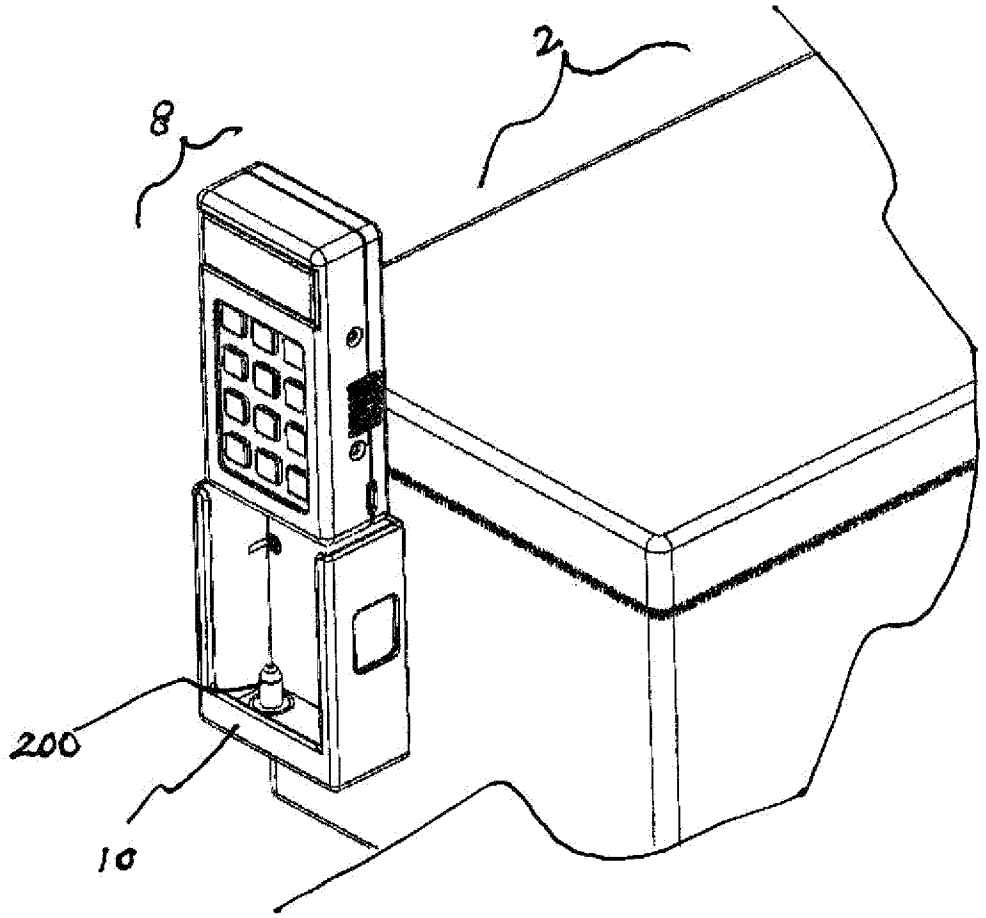
FIG. 3 is a partial perspective view of the invention with the code number receiving housing removed from its retaining holster.

FIG. 3 shows the code receiving unit 8 being removed from the holster 10. An electrical connection point 200 can be seen which interacts with a mating connector 38 on the underside of the code receiving unit 8. This connection provides the electrical conduit for sending a signal from the code receiving unit 8 to an electro-mechanical assembly 26 located within the enclosure 2 that causes the U-shaped locking finger 12 to slide in or out to lock or unlock the zipper pull of the lid of the enclosure 2.

Figure 4:
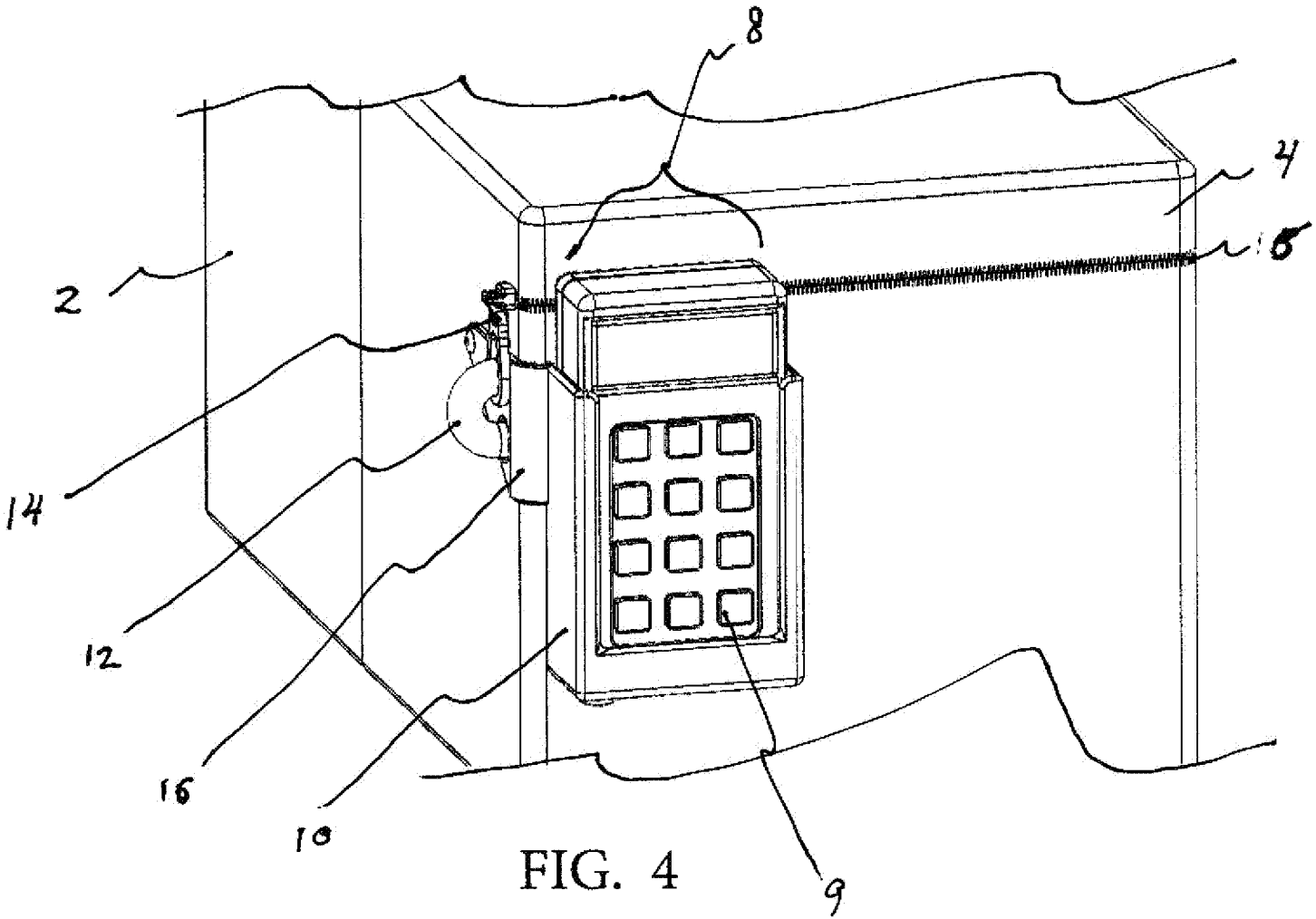
FIG. 4 is a partial perspective view of the invention showing the U-shaped locking finger in the locked position.

FIG. 4 shows the number code receiving device sitting in holster 10 with the U-shaped locking finger 12 in the locked position.

Figure 5:
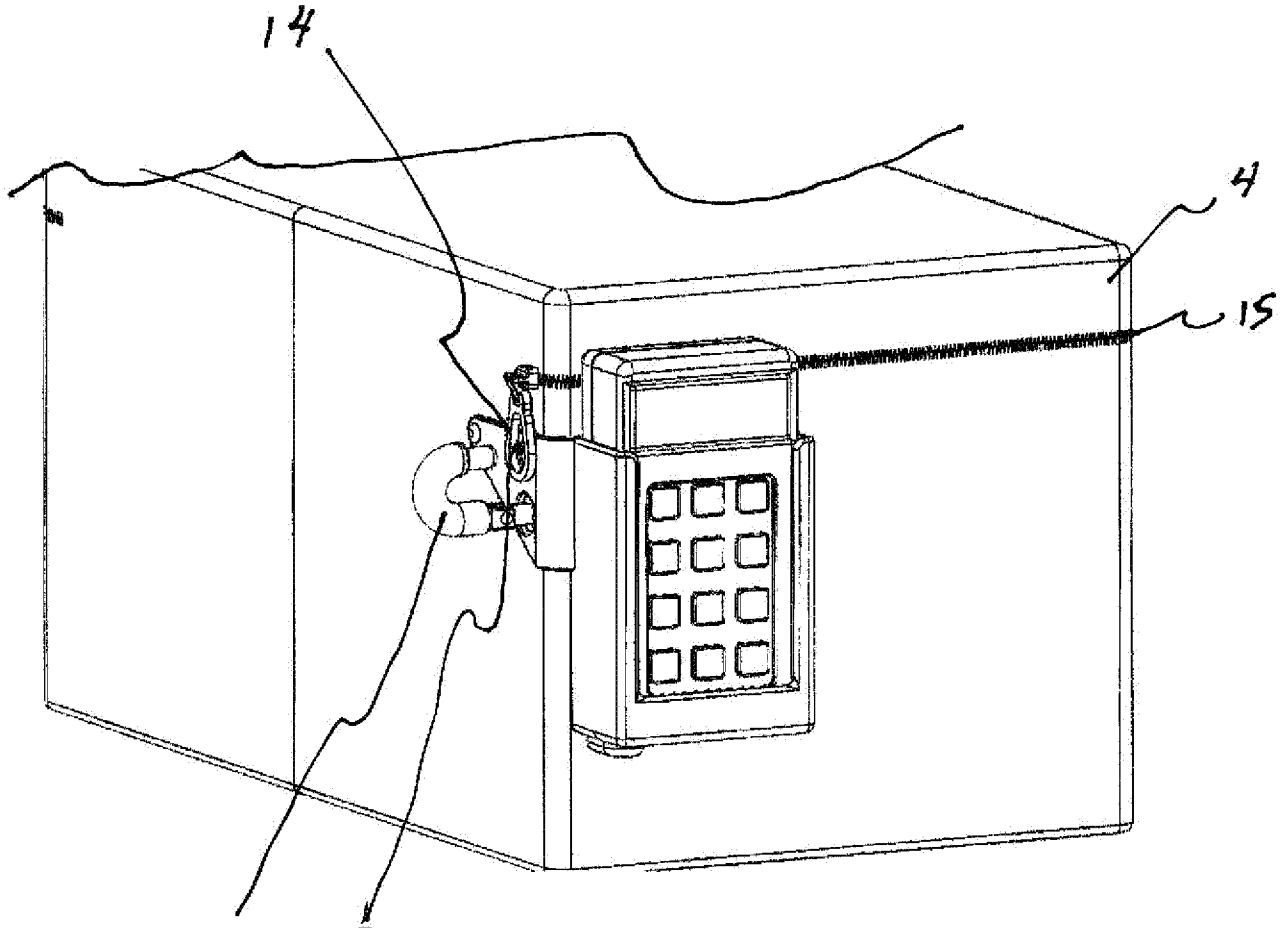
FIG. 5 is a partial perspective view of the invention showing the U-shaped locking finger in the unlocked position.

FIG. 5 shows the U-shaped locking finger in the unlocked position, allowing free access to zipper pull 14 because the U-shaped locking finger 12 has exited zipper pull aperture 13.

Figure 6:
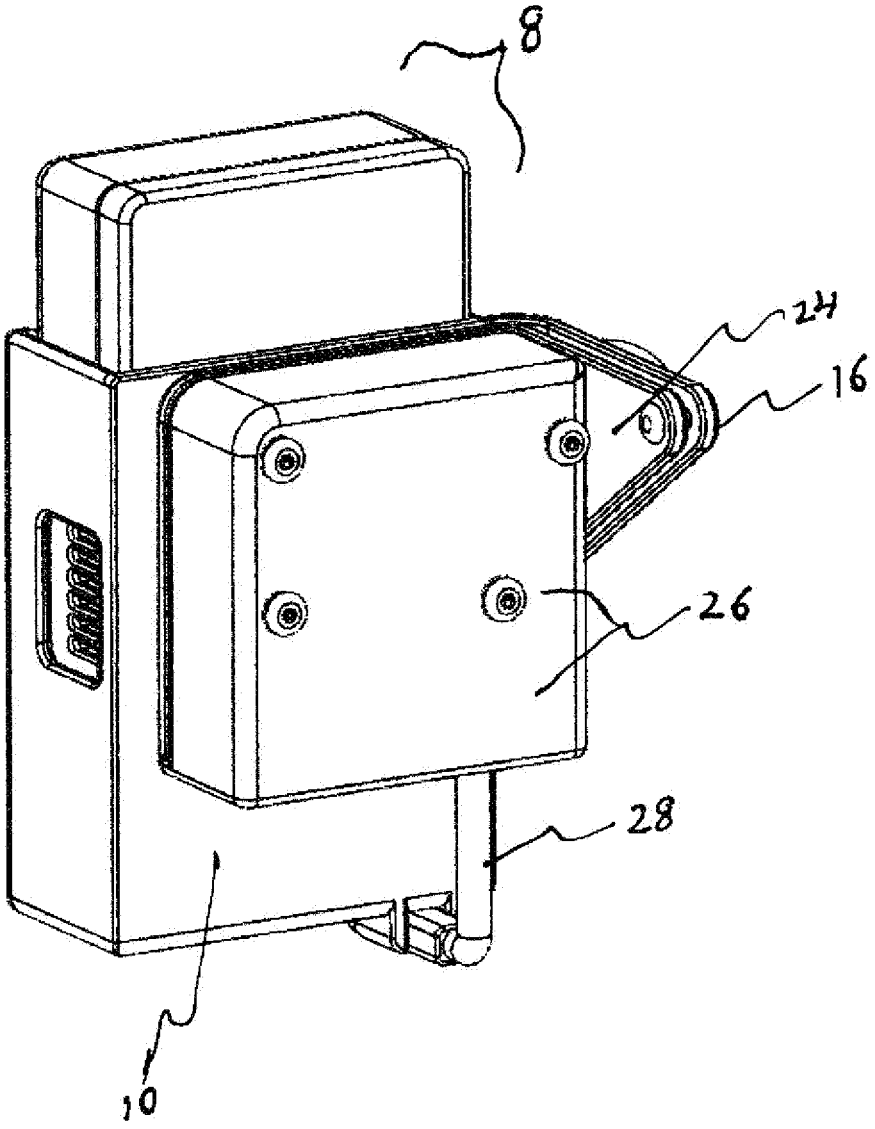
FIG. 6 is perspective view of the housing for the electro-mechanical locking assembly.
Figure 10:
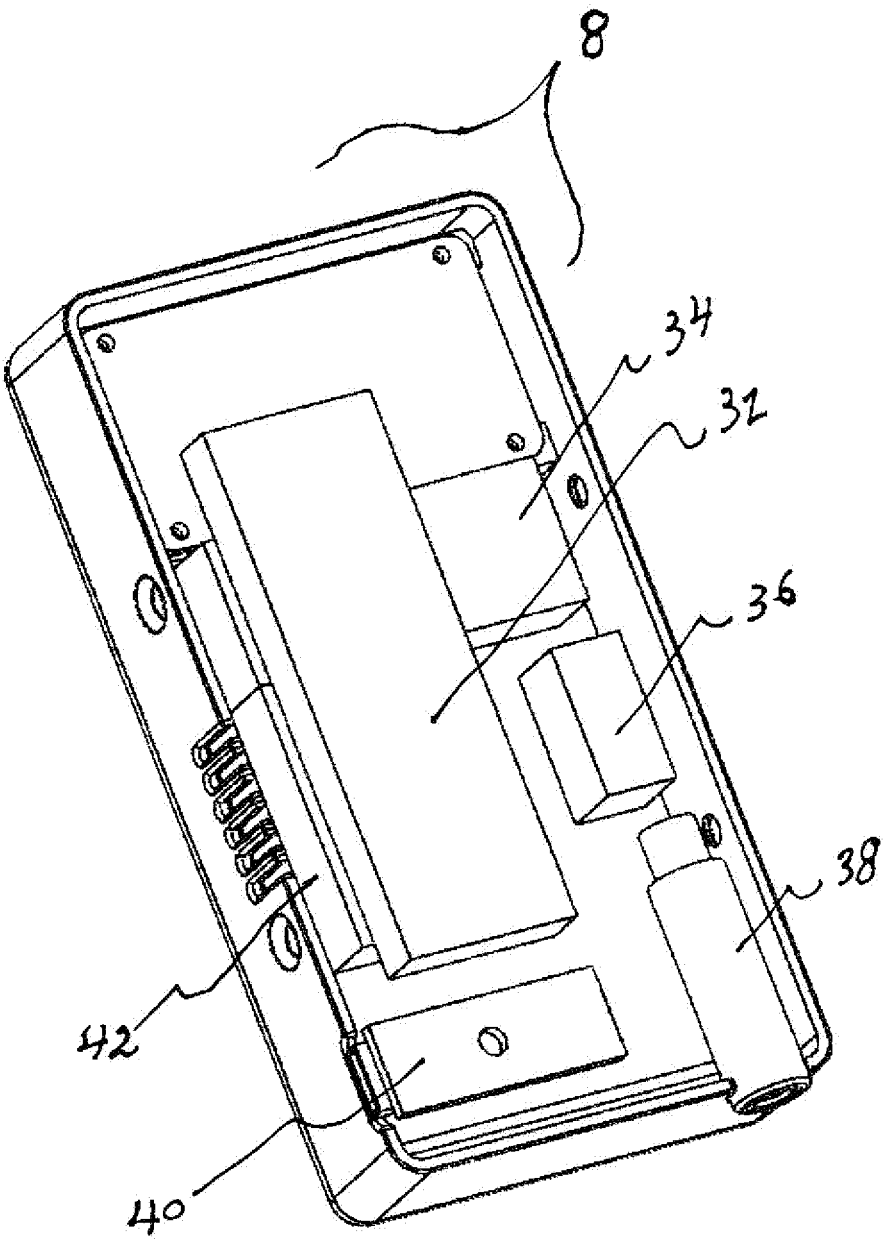
FIG. 10 is a perspective view of the interior of the code number receiving housing.
Figure 13:
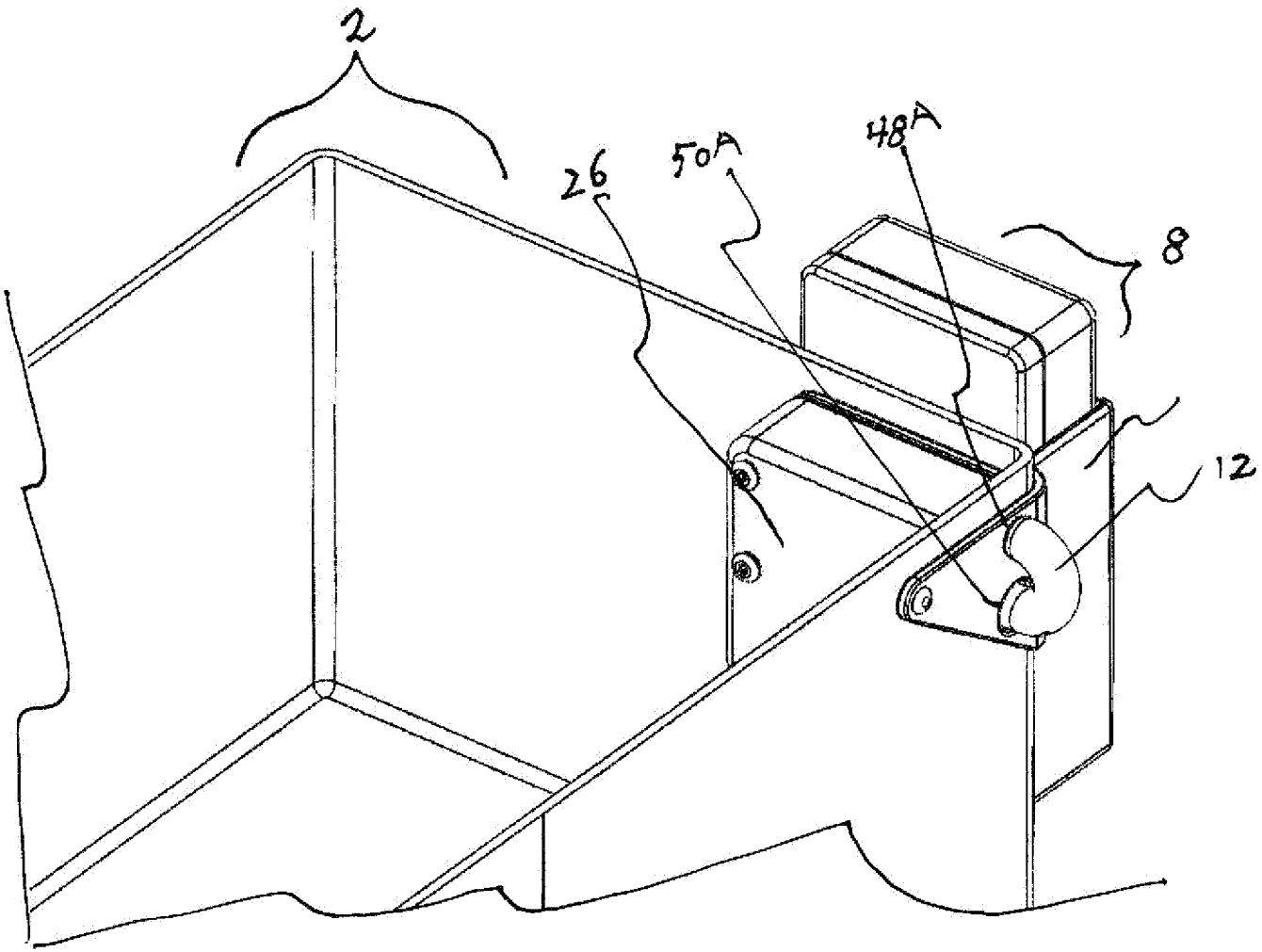
FIG. 13 is a partial perspective view of the electro-mechanical locking assembly attached to the inside of the enclosure box.

FIG. 6 shows the housing 26 of the electro-mechanical lock assembly. The housing 26 includes a flange 24 that is parallel to and in close proximity to holster flange 16. The side wall of the enclosure 2 is trapped between the rear wall of holster 10 and the front wall of housing 26 as shown in FIG. 13. Cable 28 acts as a conduit between the microprocessor 34 within the code receiving housing 8 as shown in FIG. 10.

Figure 7:
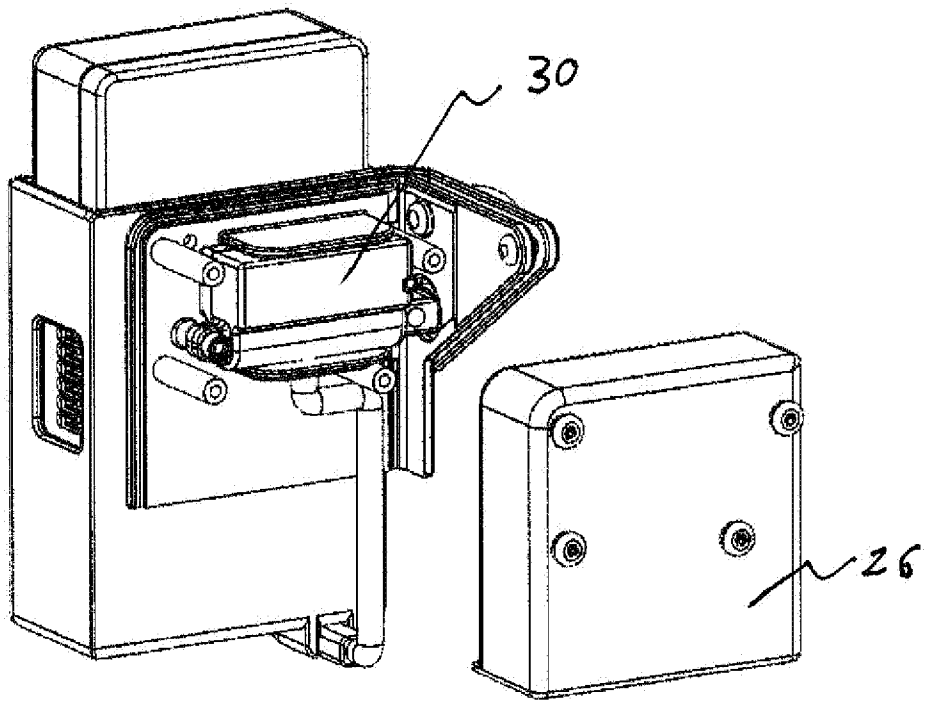
FIG. 7 is an exploded view with the rear of the electro-mechanical housing removed.

FIG. 7 shows the housing cover 26 removed exposing electro-mechanical linear translation device 30.

Figure 8:
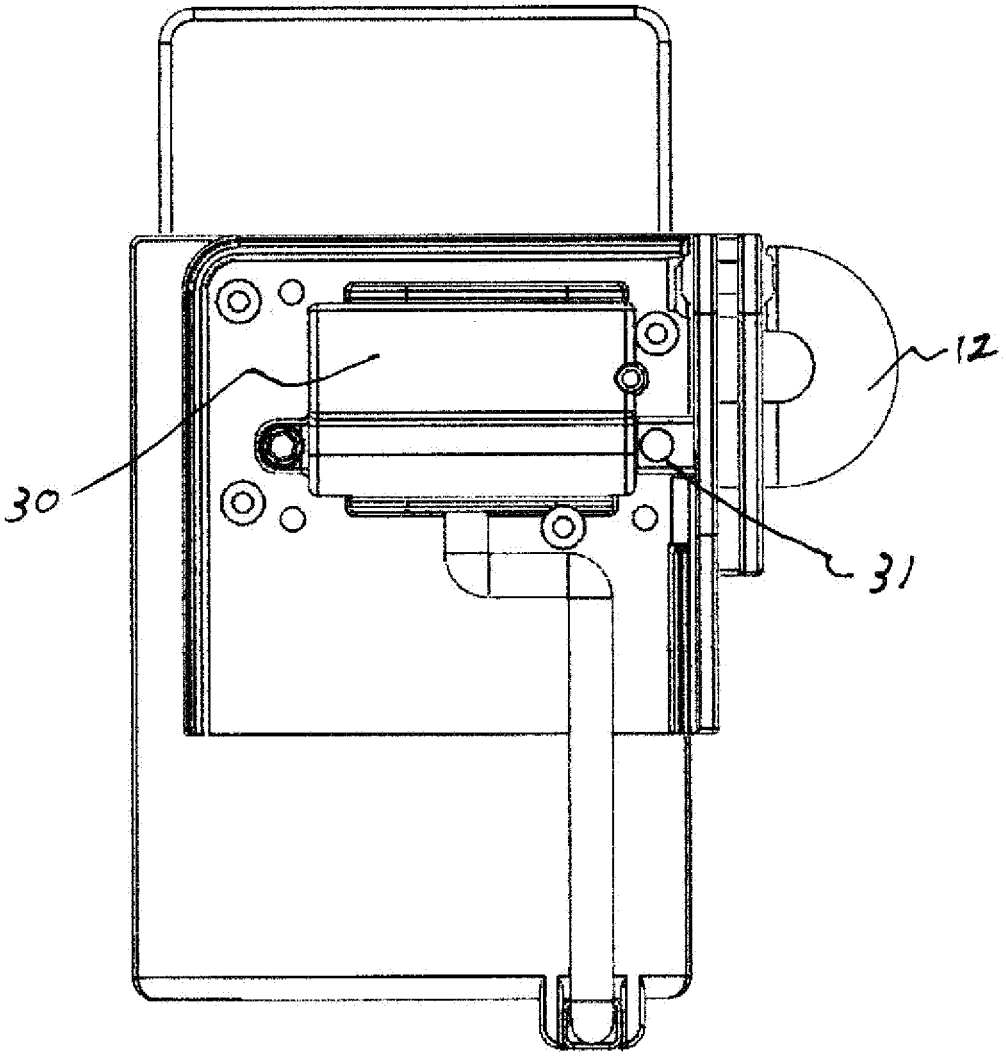
FIG. 8 is a front view of the interior of the electro-mechanical locking assembly.

FIG. 8 shows a front view of the linear translation device 30 whose shaft 31 is fixedly attached to the U-shaped locking finger 12.

Figure 9:
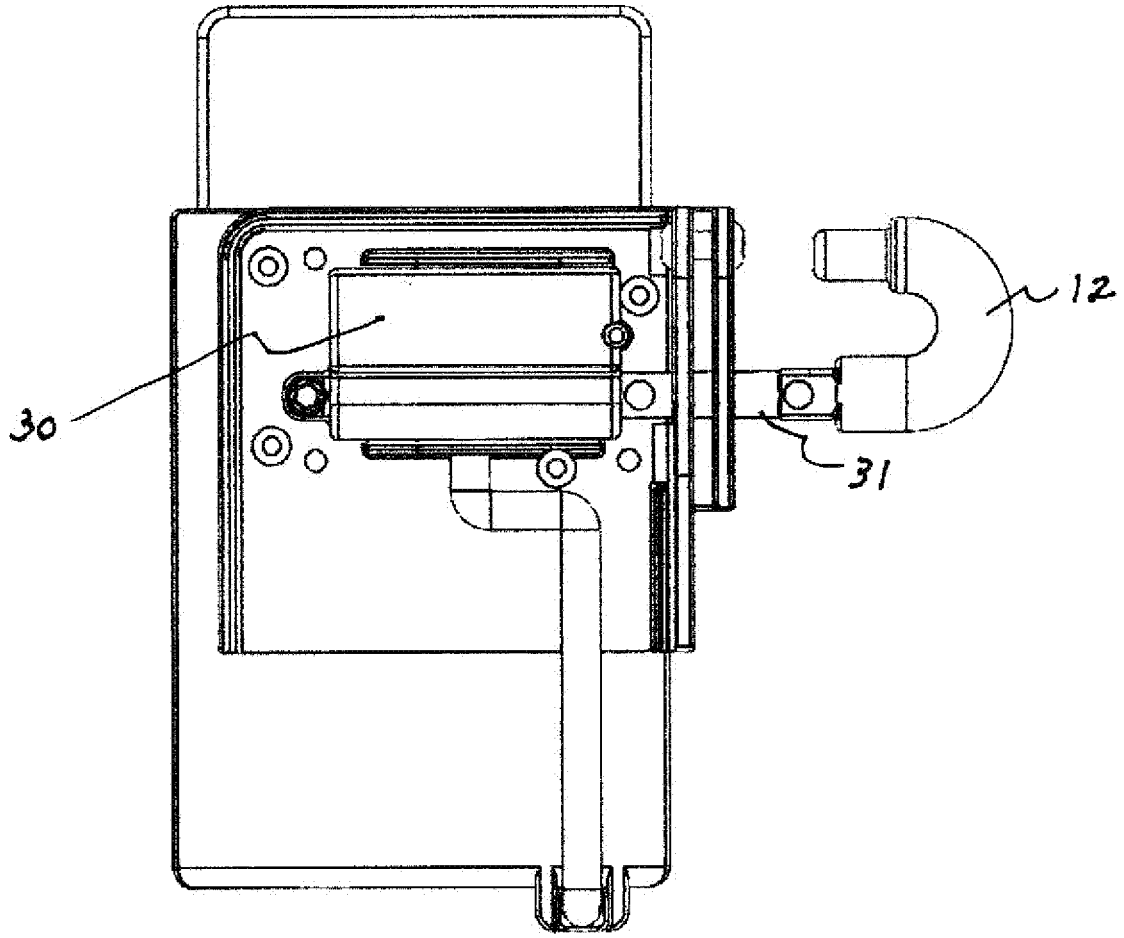
FIG. 9 is a front view of the interior of the electro-mechanical locking assembly in the unlocked position.

FIG. 9 shows the U-shaped locking finger 12 in the open position as shaft 31 has forced it open.

FIG. 10 shows the number code receiving housing 8 with the rear panel removed exposing rechargeable battery 32, microprocessor 34, microphone 42, battery charging port 40, cable receptacle 38 and short-range receiver 36.

Figure 11:
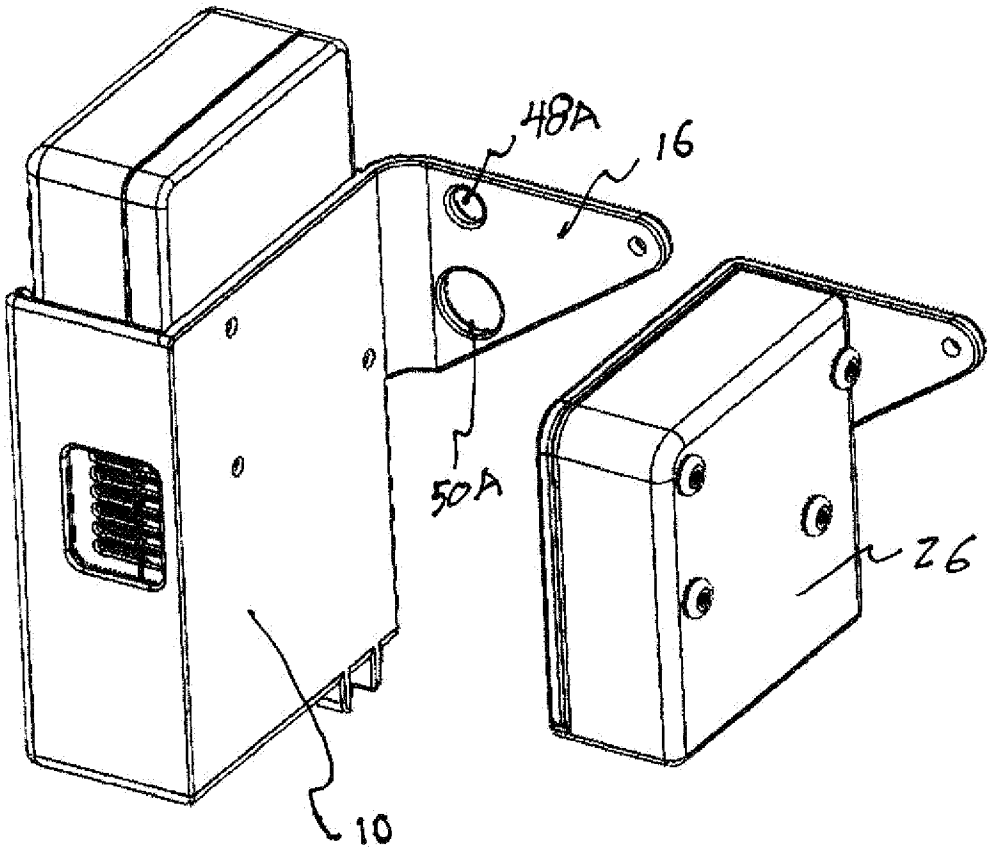
FIG. 11 is a perspective view of the electro-mechanical locking assembly removed from the code number housing.
Figure 12:
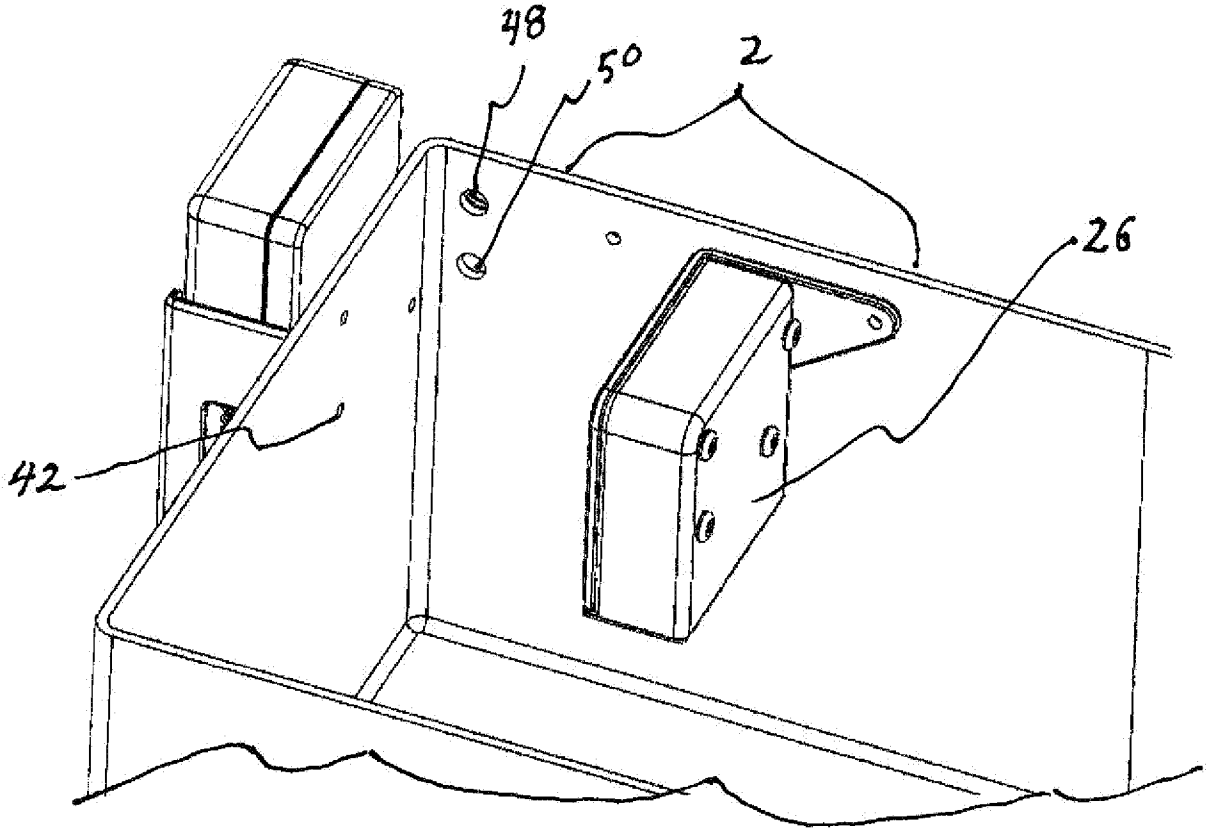
FIG. 12 is a perspective view of the electro-mechanical locking assembly about to be installed within the enclosure box.

FIGS. 11 and 12 shows the electro-mechanical assembly 26 about to be attached to the rear of holster 10 via screws that enter apertures 48. Note that apertures 48, 50 are shown in the side wall of enclosure 2 which correspond to the apertures 48A and 50A shown flange 16 in FIG. 11.

FIG. 13 shows the electro-mechanical housing 26 in place on the inside wall of enclosure 2 and U-shaped locking finger 12 in the locked position as it penetrates apertures 48A and 50A.

Figure 14:
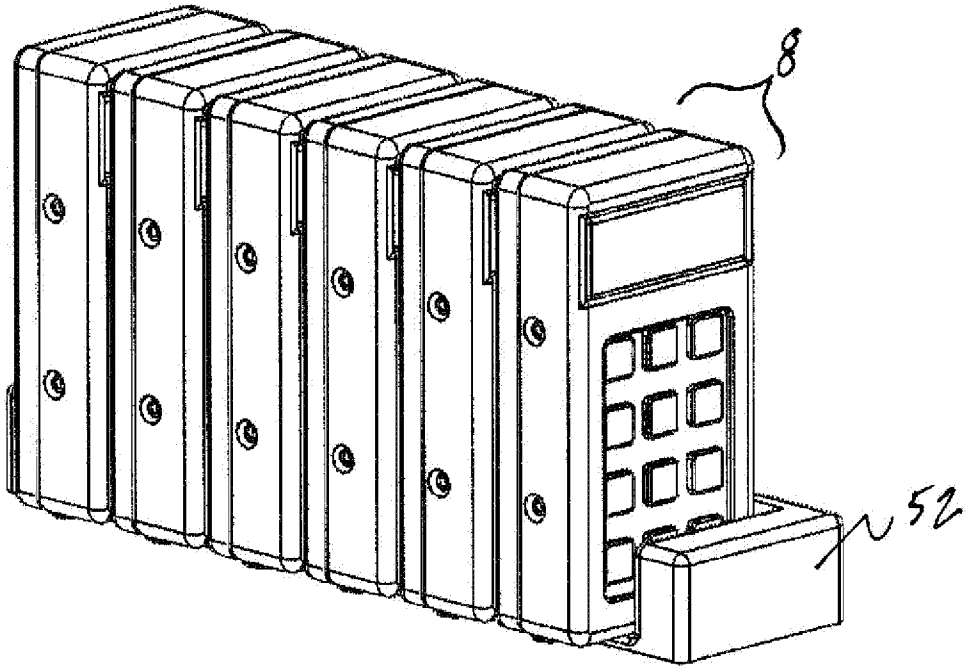
FIG. 14 is a perspective view of a code number receiving housing about to be inserted into a charging station.

FIG. 14 shows a plurality of number code receiving devices 8 installed within charger base 52.

Figure 15:
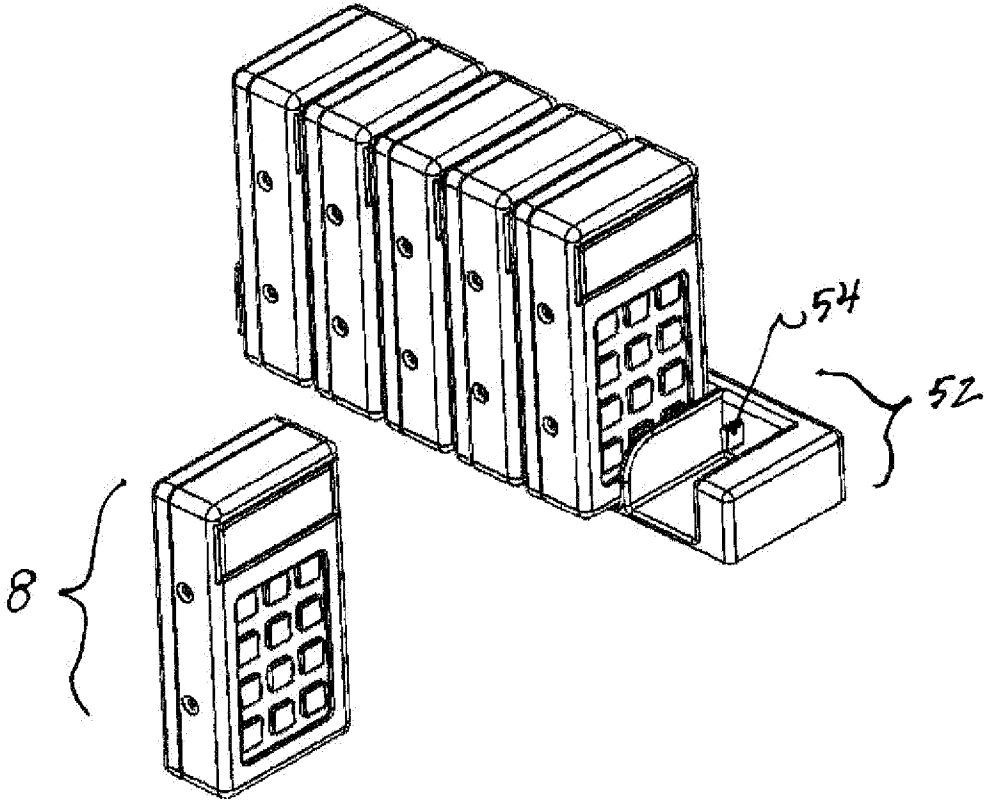
FIG. 15 is a perspective view of six code number receiving housings being recharged in a charging station.

FIG. 15 shows one number code receiving device 8 removed exposing the connection point 54 between the receiving device 8 and the charging circuit located within the charging station housing 52. This connection 54 also acts as a conduit for sending a unique numerical code to the number code receiving device 8. Each time the receiving device 8 is inserted into the charger base 52, a new code is generated. The new code is then sent to the recipient of the enclosure 2.

It should be noted that the above described lockable enclosure can be used for purposes other than food delivery where an item needs to be delivered and the person sending the item wants to make sure that the person doing the delivering cannot gain access to the item, and that only the authorized recipient can gain access to the contents of the enclosure.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A programmable lock box comprising:

an essentially cube shaped enclosure comprised of six walls, one of the walls fixedly attached to four adjacent walls;

a lid comprised of the wall opposite the fixedly attached wall includes one edge hingedly attached to one of the four adjacent walls and three unattached edges;

a zipper closure comprising a pull with an aperture, disposed along the three unattached edges of the lid and along unattached three edges of the adjacent walls;

a lock assembly comprising:

a number code receiver assembly enclosed in a number code receiver housing comprising: a user code entry keypad; a code numeric display; a code generating and decoding system comprising a programmable microprocessor; a microphone; a code text transmitting system to a smart phone; a rechargeable battery;

the number code receiver assembly removably located in a holster fixedly attached to an outside lock box wall, the holster including a metal flange;

an electro-mechanical lock assembly housing fixedly attached to the lock box inside wall in close proximity to the code receiver holster, the lock assembly housing comprising a metal flange;

the electro-mechanical lock assembly comprising an electro-mechanical sliding U-shaped locking finger that extends through apertures in the metal flanges through apertures in the lock box wall trapping the zipper pull aperture;

an electrical connection from the number code receiver assembly to the electro-mechanical lock assembly for sending a signal to slide the U-shaped locking finger in or out to lock or unlock the zipper pull;

the number code receiver further comprising an electronic numerical code generating system; and a texting system that sends the numerical code to a smart phone of a recipient of the lock box.

2. A programmable lock box as claimed in claim 1, wherein the number code receiver housing is removable and can be placed in a charging station and recharged via a recharging cable; and the recharging cable is also capable of conducting a unique number code to the number code receiving assembly, wherein furthermore upon inserting the number code receiver housing into the recharging station a previously stored number code in the receiving assembly is automatically replaced with a newly generated code.

3. A programmable lock box as claimed in claim 1, wherein the unlock code is entered by a lock box recipient by entering the unlock code via the numeric keypad causing the U-shaped locking finger to release the zipper pull.

4. A programmable lock box as claimed in claim 1, wherein the unlock code is entered by a lock box recipient by entering the unlock code via the microphone by playing an audio tone of the unlock code on the recipient's phone causing the U-shaped locking finger to release the zipper pull.

5. A programmable lock box as claimed in claim 1, wherein the lock box walls are insulated.

* * * * *